United States Patent [19]

Laurent

[11] 4,253,479

[45] Mar. 3, 1981

[54] EXTENDABLE CANE

[76] Inventor: André Laurent, 23900 Santa Cruz Hwy., Los Gatos, Calif. 95030

[21] Appl. No.: 81,641

[22] Filed: Oct. 4, 1979

Related U.S. Application Data

[63] Continuation-in-part of Ser. No. 71,011, Aug. 30, 1979.

[51] Int. Cl.[3] ..... A45B 9/00

[52] U.S. Cl. ..... 135/69; 135/75

[58] Field of Search ..... 135/65–75

[56] References Cited

U.S. PATENT DOCUMENTS

| | | | |
|---|---|---|---|
| 1,905,076 | 4/1933 | Van Sciver | 135/66 |
| 2,041,334 | 5/1936 | Hage | 135/75 |
| 2,474,722 | 6/1949 | Blume | 135/69 |
| 2,593,026 | 4/1952 | Hawkins | 135/66 |
| 3,029,828 | 4/1962 | Kravitt | 135/66 |
| 4,091,828 | 5/1978 | Jorgensen | 135/67 |

FOREIGN PATENT DOCUMENTS

| | | | |
|---|---|---|---|
| 341496 | 10/1921 | Fed. Rep. of Germany | 135/65 |

*Primary Examiner*—J. Karl Bell

*Attorney, Agent, or Firm*—Robert G. Slick

[57] ABSTRACT

A cane or similar article such as a crutch or ski pole is provided with a hand operated lever whereby the user can extend the cane by squeezing on a pair of hand grips.

3 Claims, 7 Drawing Figures

EXTENDABLE CANE

REFERENCE TO RELATED APPLICATION

This application is a continuation-in-part of application Ser. No. 071,011, filed Aug. 30, 1979.

SUMMARY OF THE INVENTION

The present invention relates to a cane or similar article such as a ski pole or crutch.

Many people who have difficulty in walking use a cane. As the user steps forward, the cane extends to the rear of the person and it would be highly desirable to provide a cane which would extend as the user takes a step. Thus, the user could put the cane down in its retracted position and as he takes a step, squeeze on hand grips making the cane longer and making walking easier.

In accordance with the present invention, a cane or similar structure is provided, having a sleeve at the bottom, which is actuated by a hand grip. Whenever it is desired to extend the cane, the hand grip is squeezed, causing the sleeve to move down on the shaft of the cane, extending the length of the cane.

The cane of the present invention is also valuable in assisting people from rising from a chair. In rising from a chair, the cane of the present invention provides an extra boost which is quite often desirable; by utilizing the cane of the present invention, the user can get himself into an upright position much more easily.

Although the device has been described as a cane, it will be obvious that there many other applications and that the structure of the present invention can be incorporated in a crutch, ski pole or similar article.

Another advantage of the present invention is that it provides valuable hand and finger exercise for the user.

Various other features and advantages will be brought out in the balance of the specification.

DESCRIPTION OF THE PREFERRED EMBODIMENTS

Figure 1:
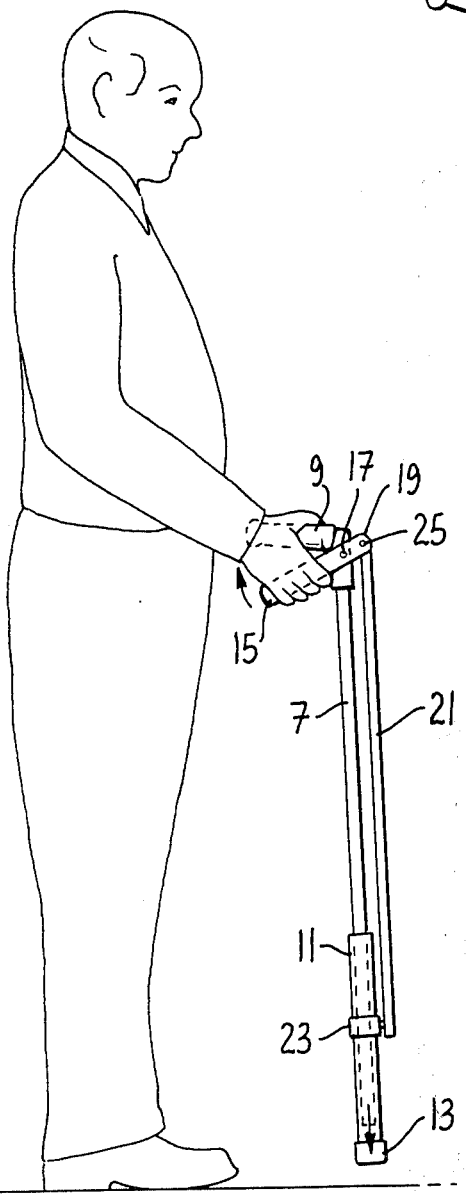
FIG. 1 is a side view showing the use of a cane embodying the present invention.

Referring now to the drawing by reference characters, the cane includes a shaft 7 with a hand grip 9 mounted at the top thereof. The hand grip 9 extends at substantially right angles to the shaft 7 although it may tilt upwards slightly as shown. Shaft 7 would normally be selected to be slightly shorter than the usual cane a person would select. At the bottom end of the shaft 7 is a sleeve 11 which forms a reasonably snug fit with the shaft 7 so that it can telescope easily back and forth over the shaft without excessive wobbling. The bottom end of the sleeve 11 advantageously is provided with a soft rubber tip 13.

A second hand grip 15 is pivoted at point 17 near the top of shaft 7. This has a lever arm 19 extending on the opposite side from the second hand grip. The first and second hand grips are adjacent to each other and the second hand grip can move from the position shown in FIG. 3 wherein it is in contact and parallel to the first hand grip to the position shown in FIG. 2, wherein it is extended from and forms an acute angle to the first hand grip. A rigid arm 21 couples the sleeve 11 to the lever arm 19. At the bottom, the arm 21 is fastened to a sleeve 23 which is attached to sleeve 11 and at the top it is pivoted at point 25 to the lever arm 19. It will be noted that the bottom end 8 of the shaft 7 extends to the end of sleeve 11 when the hand grips are relaxed, as in FIG. 2, so that shaft 7 directly bears the weight placed on hand grip 9.

Figure 2:
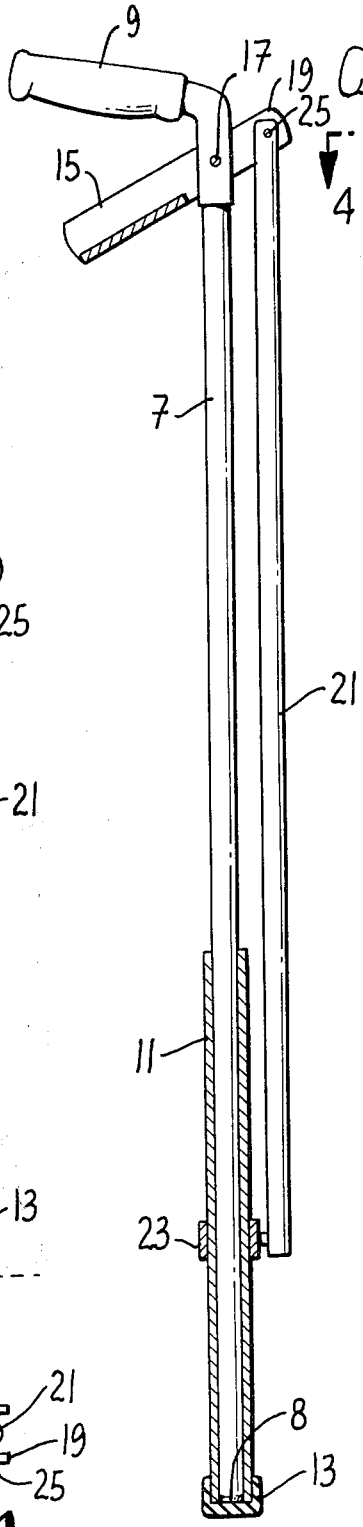
FIG. 2 is an enlarged side view, partly in section, of a cane embodying the present invention showing the cane in its retracted position.
Figure 3:
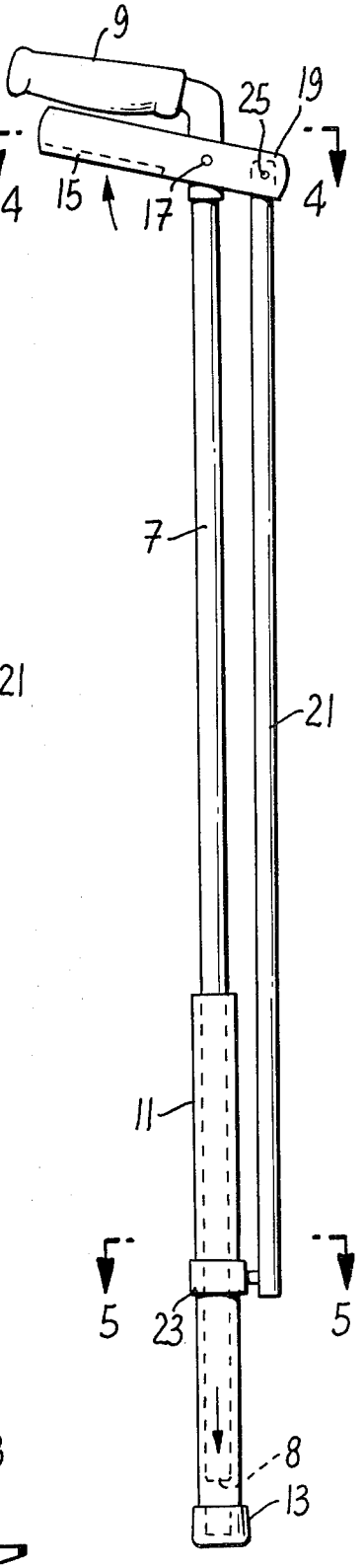
FIG. 3 is a side view of the cane showing it in the extended position.

In use, the user assumes the position shown in FIG. 1 with hand grip 9 generally in the palm of his hand with the fingers extending around the second hand grip 15. As he bears weight on the hand grip 9, it will force sleeve 11 upwardly with respect to shaft 7 so that the hand grips will separate as is shown in FIGS. 1 and 2. Now, as the user steps forward, he squeezes on the hand grips 9 and 15 and this will extend the cane to its full length as shown in FIG. 3, greatly assisting the user in walking or rising.

Many variations can be made in the exact structure shown without departing from the spirit of this invention. For instance, the shaft 7 may be extended upwardly beyond hand grip 9 up to a weight supporting element as in an ordinary crutch wherein the top fits in the arm pit of the user; the arms of the user would extend downwardly so that the user still would grasp 9 and 15 as shown. Obviously, more than one of the devices could be used so that in some cases such as canes, ski poles or the like devices could be provided for both hands of the user.

Figure 6:
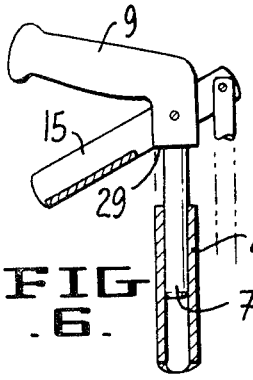
FIG. 6 is a fragmentary view of another embodiment of the invention.
Figure 4:
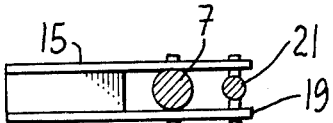
FIG. 4 is a section on the line 4—4 of FIG. 3.
Figure 5:
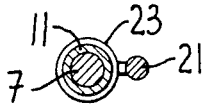
FIG. 5 is a section on the line 5—5 of FIG. 3.

In FIG. 6 an alternate stop is shown. Here a longer sleeve 27 is employed which engages on a shoulder 29 of hand grip 9 to act as a stop when the sleeve is in the up position. Thus, the shaft 7 can be much shorter.

Figure 7:
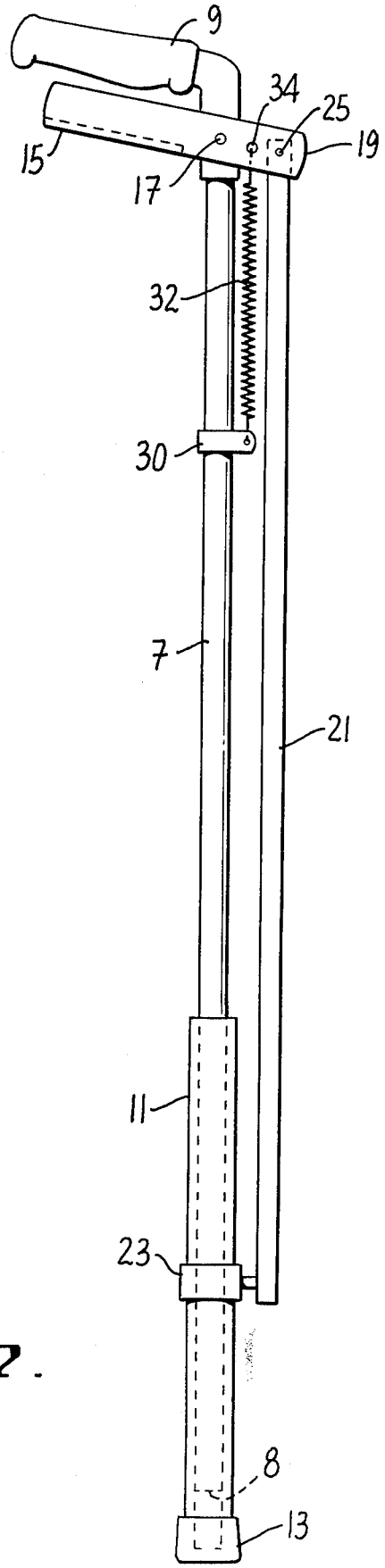
FIG. 7 is a side view, similar to FIG. 3, showing a modified cane with a spring.

It is not necessary to provide a spring since the normal action of bearing weight on hand grip 9 will cause the sleeve to rise up on the shaft, separating the hand grips as is shown in FIG. 2. However, a spring makes the action easier since thereby it is possible to balance the weight of shaft 7 and the handle 9. Referring now to FIG. 7, tension spring 32 extends from a bracket 30 on shaft 7 to an opening 34 on the movable handle 15, opening 34 being located between the pivot points 17 and 25. The action of the spring is to bias the handles to the closed position as is shown in FIG. 7. Now, as one puts weight on handle 9, handles 9 and 15 will separate. The action of the spring cushions the cane as it contacts the ground and slight pressure on handle 15 allows excellent control of the action. Otherwise, the cane is used exactly as previously described.

The bottom member 11 has been described as a sleeve telescoping on the shaft 7. This is a preferred embodiment since the sleeve is a simple, strong mechanism. However, another form of sliding member might be employed wherein the member merely is provided with glides so that it can slide along shaft 7.

Many other variations can be made in the exact structure shown.

I claim:

1. A cane, ski pole, crutch or the like comprising in combination:

a. a shaft adapted to bear a portion of the weight of a user, b. a first hand grip fixed to the upper end of said shaft and extending at about a right angle to said shaft, c. a second hand grip pivoted at a point on said shaft below said first hand grip, said second hand grip being movable from a first position where it rests parallel to and in contact with said first hand grip to a second position where it is spaced from and forms an acute angle with said first hand grip, d. said second hand grip having a lever arm extending on the opposite side of said shaft, e. sliding member extending beyond the bottom end of said shaft, said member being mounted for sliding movement on said shaft, f. a stiff member attaching said sliding member to the outer end of said lever, g. whereby a user can squeeze the first and second hand grips together to extend said sliding member beyond the end of said shaft and release said hand grips to retract said sliding member.

2. The structure of claim 1 wherein the sliding member is a sleeve telescoping on said shaft.

3. The structure of claim 1 having in addition a spring tending to bias the first and second hand grips together to said first position.

* * * * *